US006394550B1

(12) United States Patent
Liu

(10) Patent No.: US 6,394,550 B1
(45) Date of Patent: May 28, 2002

(54) CHAIR ADJUSTMENT ASSEMBLY

(76) Inventor: Gen-Fong Liu, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/933,241

(22) Filed: Aug. 17, 2001

(51) Int. Cl.[7] ..... A47C 1/032
(52) U.S. Cl. ..... 297/374; 297/301.7
(58) Field of Search ..... 297/374, 300.8, 297/300.1, 300.2, 301.1, 301.7, 302.1, 302.7, 313

(56) References Cited

U.S. PATENT DOCUMENTS 4,636,004 A * 1/1987 Neumuller ..... 297/374
5,066,069 A * 11/1991 DeGelder ..... 297/374
5,423,595 A * 6/1995 Hancock ..... 297/374
5,560,682 A * 10/1996 Brown ..... 297/374
5,676,425 A * 10/1997 Pernicka ..... 297/374
6,131,998 A * 10/2000 Su ..... 297/300.5

* cited by examiner

*Primary Examiner*—Peter R. Brown

(57) ABSTRACT

A chair adjustment assembly has a base seat, a pneumatic mount disposed on the base seat, connection mount connected to the base seat, an L-shaped plate disposed on a bottom of the connection mount, and an adjustment device disposed on the pneumatic mount. The adjustment device has a positioning seat, a connection seat disposed on the positioning seat, a washer, a coiled spring, a plurality of gaskets, a plurality of oblong plates, a tube, a nut, a shaft passing through the connection seat, the washer, the coiled spring, the-gaskets, the oblong plates, the tube, the positioning seat, and the nut, a square plate inserted in the connection seat, and a control handle. A pintle fastens the connection seat and the control handle together.

1 Claim, 7 Drawing Sheets

CHAIR ADJUSTMENT ASSEMBLY

BACKGROUND OF THE INVENTION

The present invention relates to a chair adjustment assembly. More particularly, the present invention relates to a chair adjustment assembly which has an adjustment device.

A conventional adjustment device for a chair adjusts an angle of a backrest. However, it is cumbersome to control the conventional adjustment device.

SUMMARY OF THE INVENTION

An object of the present invention is to provide a chair adjustment assembly which has an adjustment device to be operated easily.

Accordingly, a chair adjustment assembly comprises a base seat, a pneumatic mount disposed on the base seat, a connection mount, an L-shaped plate disposed on a bottom of the connection mount, and an adjustment device. The base seat has a U-shaped frame and two lug joints. The connection mount has two arm bars connected to the lug joints. A spindle fastens the arm bars and the lug joints together. The adjustment device has a positioning seat, a connection seat disposed on the positioning seat, a washer, a coiled spring, a first gasket having a first round aperture, a first oblong plate having a first oblong hole and a first circular hole, at least a second gasket having a second round aperture, at least a second oblong plate having a second oblong hole and a second circular hole, a tube, a nut, the connection seat receiving the washer and the coiled spring, the positioning seat having a bottom slot and a round hole, the positioning seat receiving the first gasket, the first oblong plate, the second gasket and the tube, a shaft passing through the connection seat, the washer, the coiled spring, the first gasket, the first oblong plate, the second gasket, the second oblong plate, the tube and the nut, a square plate inserted in the connection seat, and a control handle. The control handle has a connection block having a through hole. The connection seat has an inner interior and a through aperture. The connection block is inserted in the connection seat. A pintle fastens the connection block and the connection seat together through the through aperture of the connection seat and the through hole of the connection block. The U-shaped frame receives the first oblong plate and the second oblong plate. A pin fastens the first oblong plate, the second oblong plate, and the U-shaped frame together.

DETAILED DESCRIPTION OF THE INVENTION

Figure 1:
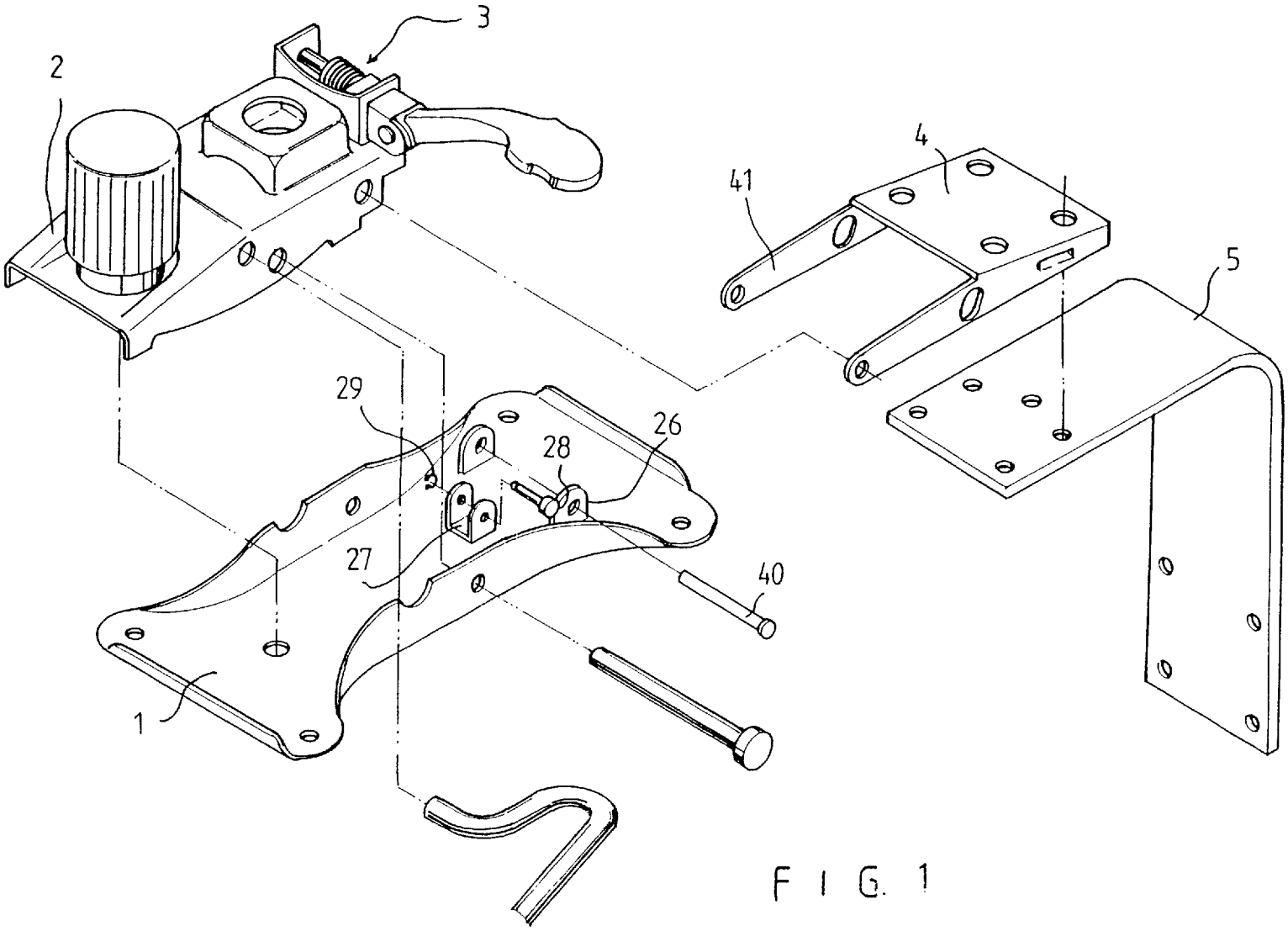
FIG. 1 is a perspective exploded view of a chair adjustment assembly of a preferred embodiment in accordance with the present invention.
Figure 2:
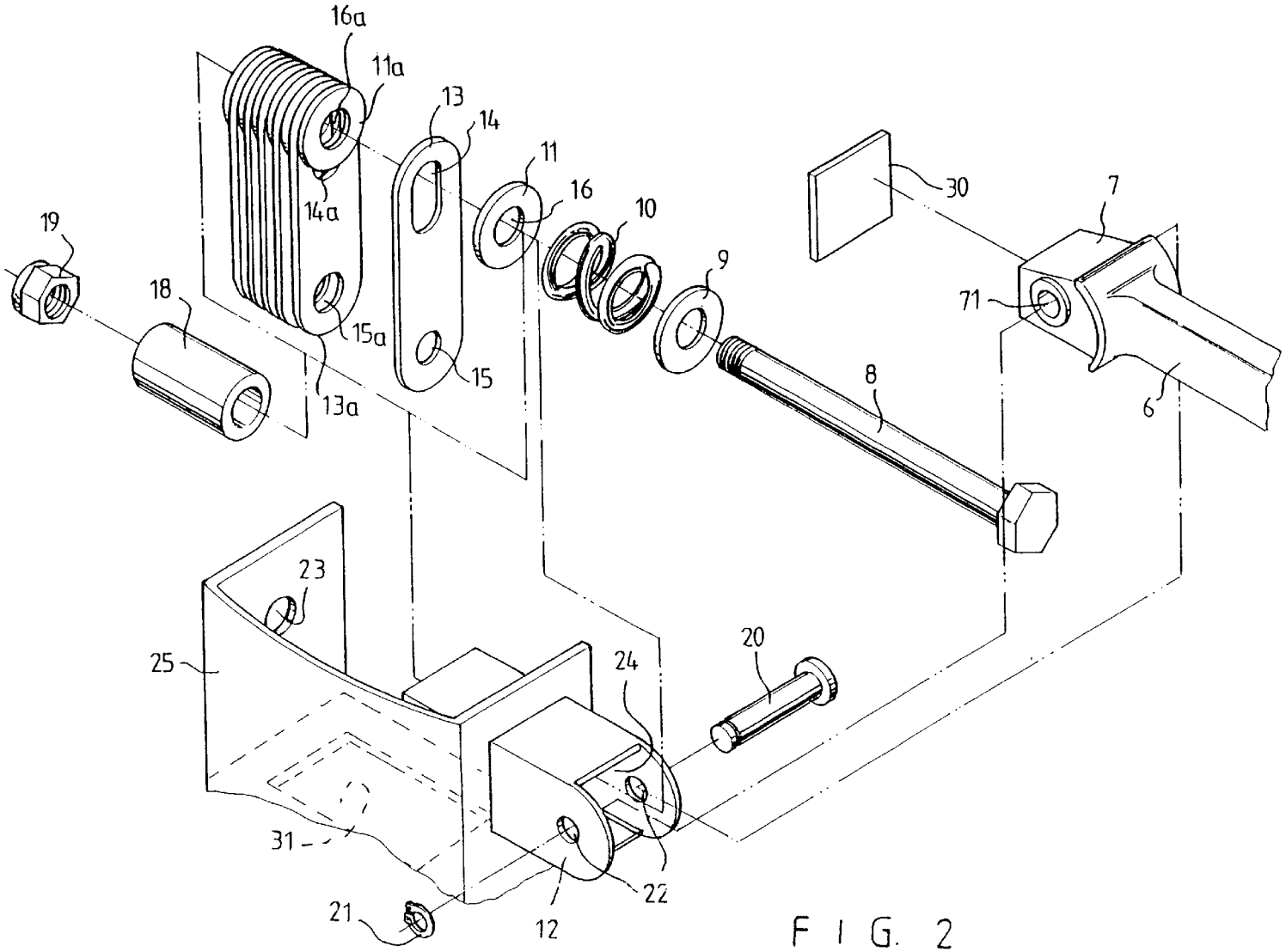
FIG. 2 is a perspective exploded view of an adjustment device of a preferred embodiment in accordance with the present invention.
Figure 3:
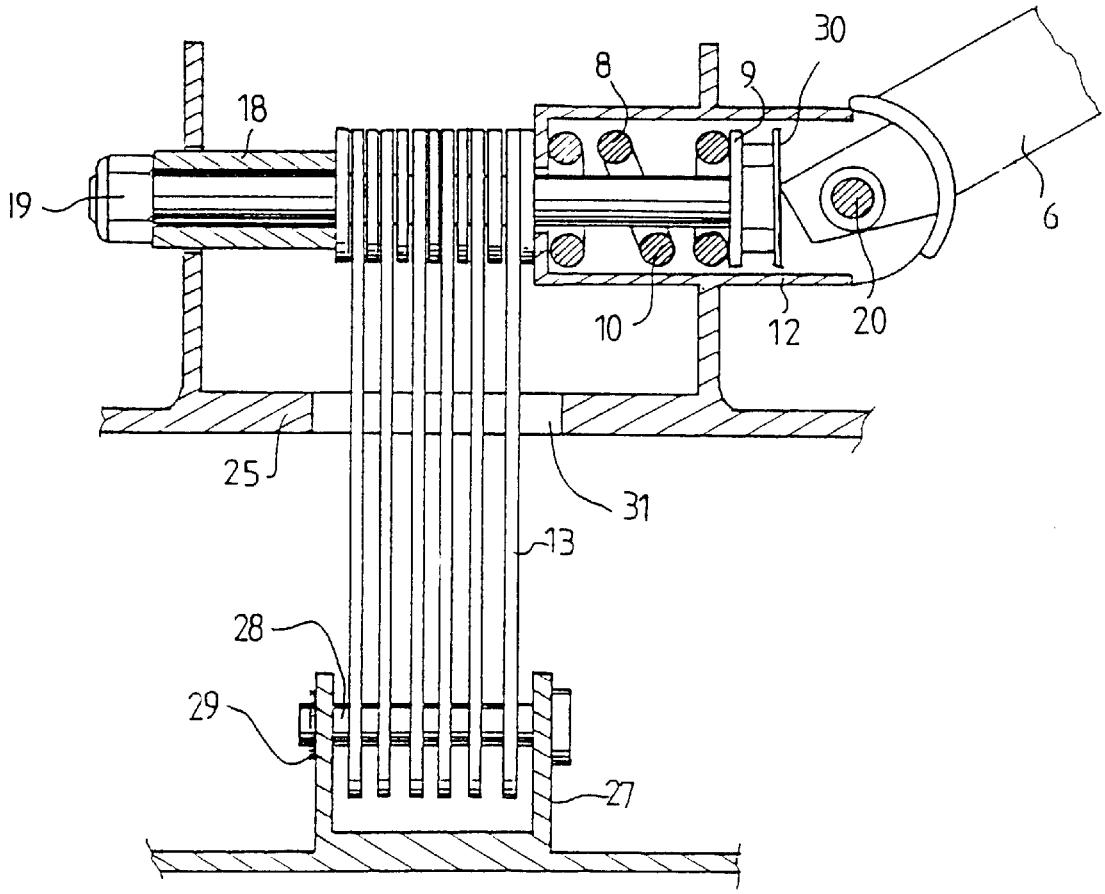
FIG. 3 is a sectional assembly view of an adjustment device of a preferred embodiment in accordance with the present invention.
Figure 4:
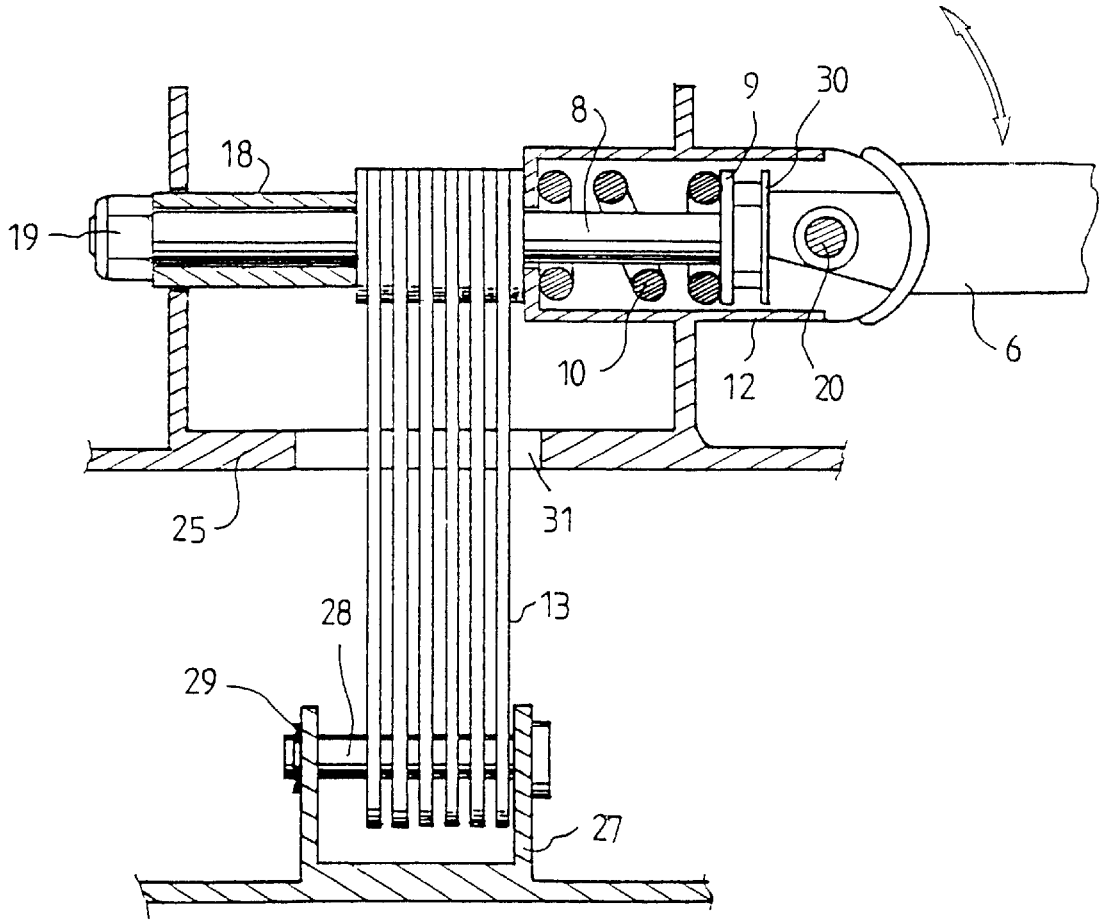
FIG. 4 is another sectional assembly view of an adjustment device of a preferred embodiment in accordance with the present invention.
Figure 5:
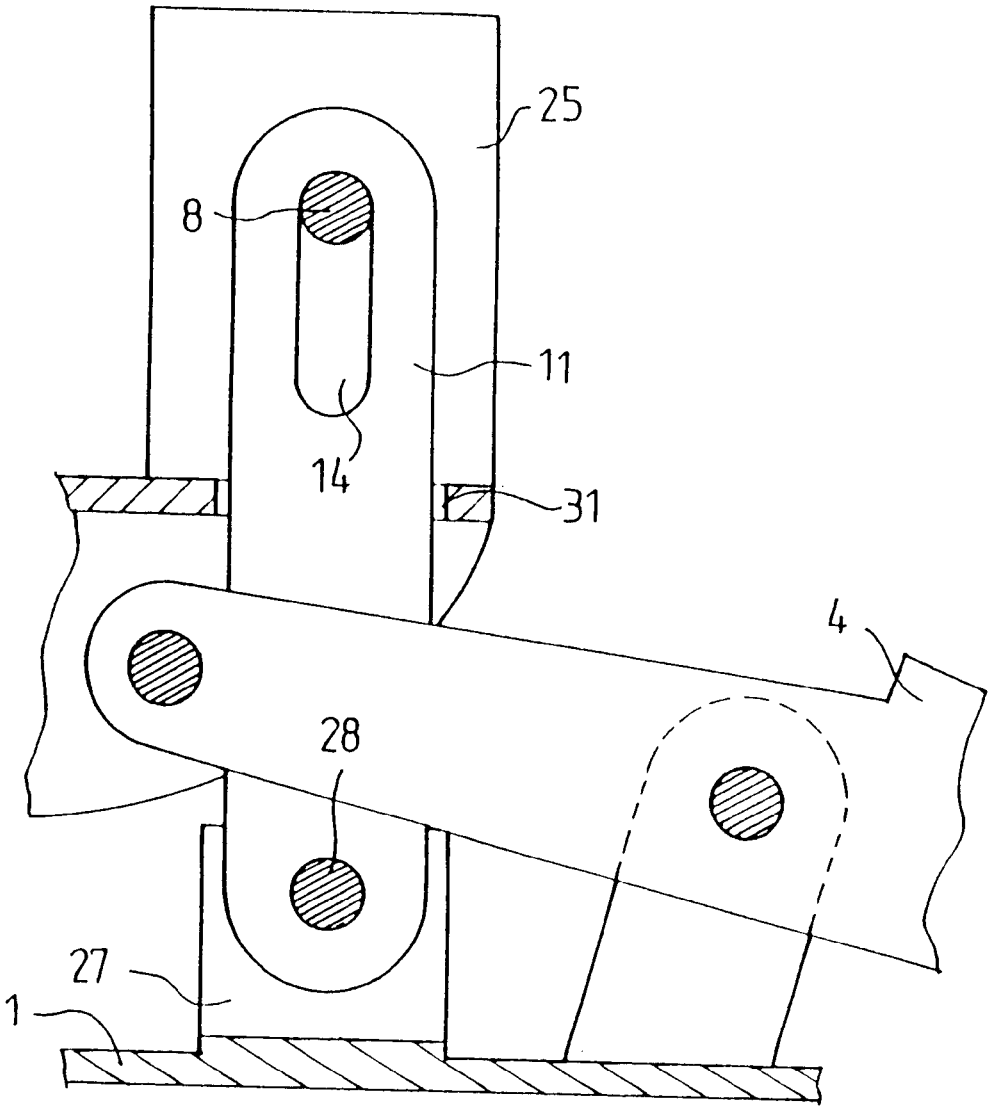
FIG. 5 is a partially sectional assembly view of a chair adjustment assembly of a preferred embodiment in accordance with the present invention.
Figure 6:
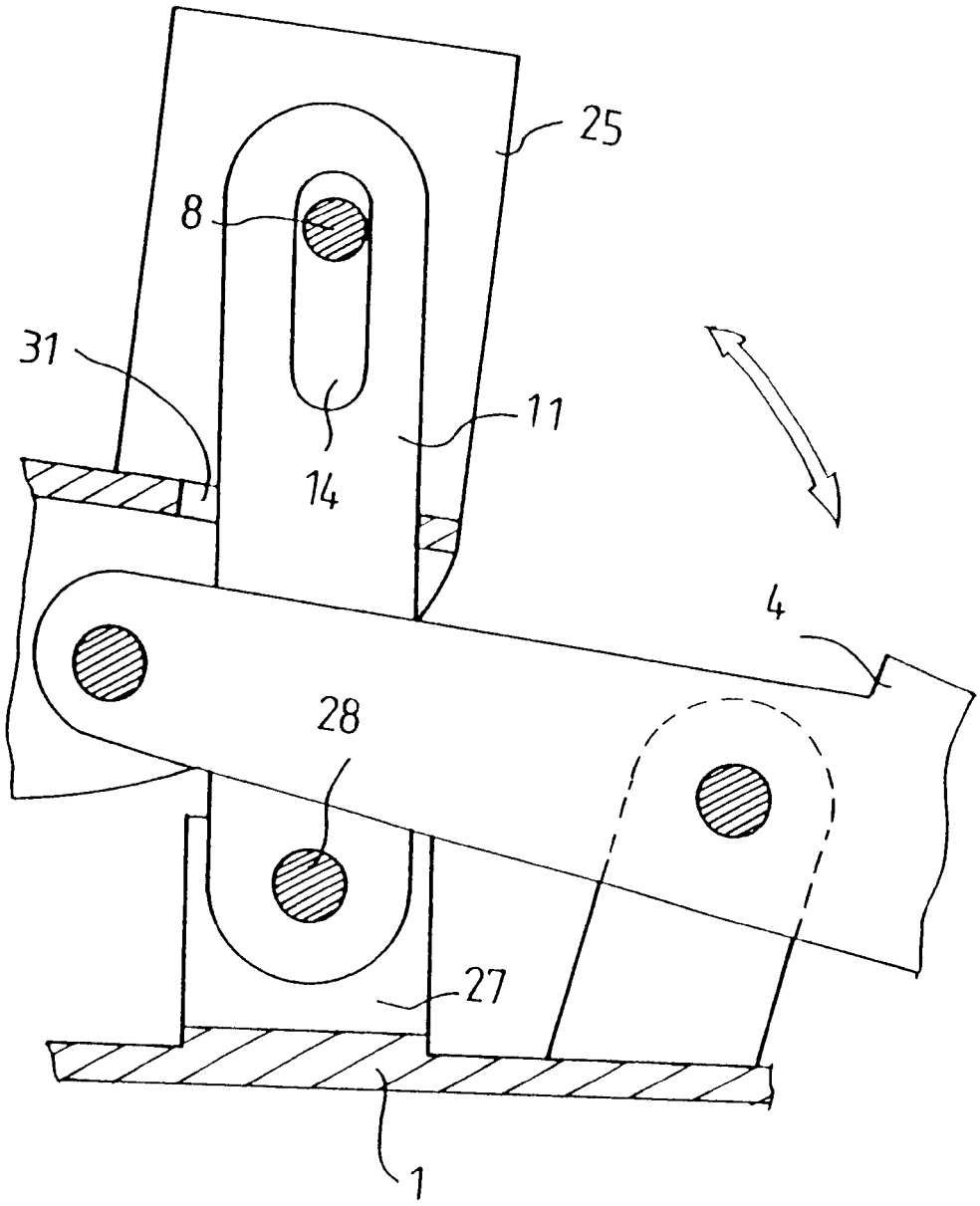
FIG. 6 is another partially sectional assembly view of a chair adjustment assembly of a preferred embodiment in accordance with the present invention.

Referring to FIGS. 1 to 6 first, a chair adjustment assembly comprises a base seat 1, a pneumatic mount 2 disposed on the base seat 1, a connection mount 4, an L-shaped plate 5 disposed on a bottom of the connection mount 4, and an adjustment device 3.

The base seat 1 has a U-shaped frame 27 and two lug joints 26.

The connection mount 4 has two arm bars 41 connected to the lug joints 26.

A spindle 40 fastens the arm bars 41 and the lug joints 26 together.

The adjustment device 3 has a positioning seat 25, a connection seat 12 disposed on the positioning seat 25, a washer 9, a coiled spring 10, a first gasket 11 having a first round aperture 11, a first oblong plate 13 having a first oblong,hole 14 and a first circular hole 15, at least a second gasket 11*a* having a second round aperture 11*a,* at least a second oblong plate 13*a* having a second oblong hole 14*a* and a second circular hole 15*a,* a tube 18, a nut 19, the connection seat 12 receiving the washer 9 and the coiled spring 10, the positioning seat 25 having a bottom slot 31 and a round hole 23, the positioning seat 25 receiving the first gasket 11, the first oblong plate 13, the second gasket 11*a* and the tube 18, a shaft 8 passing through the connection seat 12, the washer 9, the coiled spring 10, the first gasket 11, the first oblong plate 13, the second gasket 11*a,* the second oblong plate 13*a,* the tube 18 and the nut 19, a square plate 30 inserted in the connection seat 12, and a control handle 6.

The control handle 6 has a connection block 7 having a through hole 71.

The connection seat 12 has an inner interior 24 and a through aperture 22.

The connection block 7 is inserted in the connection seat 12.

A pintle 8 fastens the connection block 7 and the connection seat 12 together through the through aperture 22 of the connection seat 12 and the through hole 71 of the connection block 7.

A C-shaped ring 21 engages with the pintle 8.

The U-shaped frame 27 receives the first oblong plate 13 and the second oblong plate 13*a*.

A pin 28 fastens the first oblong plate 13, the second oblong plate 13*a,* and the U-shaped frame 27 together.

A C-shaped retainer 29 engages with the pin 28.

Referring to FIG. 4 again, the control handle 6 is pressed downward. Then the first oblong plate 13, the second gasket 11*a,* and the second oblong plate 13*a* are pressed together.

Figure 7:
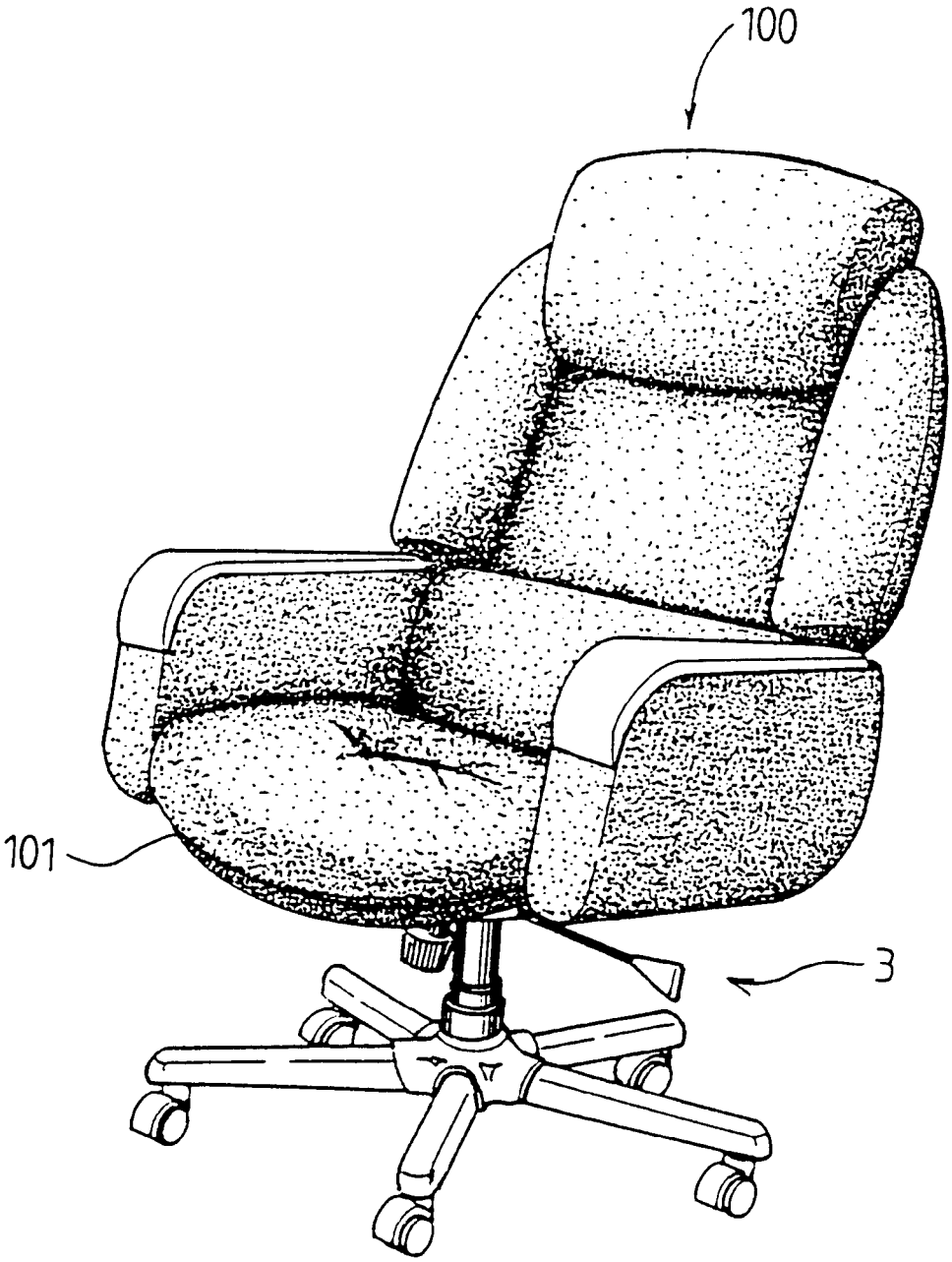
FIG. 7 is a perspective view of a chair of a preferred embodiment in accordance with the present invention.

Referring to FIG. 7, a chair 100 has a seat 101. The chair adjustment assembly is disposed on a bottom of the seat 101.

The invention is not limited to the above embodiment but various modification thereof may be made. Further, various changes in form and detail may be made without departing from the scope of the invention.

I claim:

1. A chair adjustment assembly comprises:

a base seat, a pneumatic mount disposed on the base seat, a connection mount, an L-shaped plate disposed on a bottom of the connection mount, and an adjustment device, the base seat having a U-shaped frame and two lug joints, the connection mount having two arm bars connected to the lug joints, a spindle fastening the arm bars and the lug joints together, the adjustment device having a positioning seat, a connection seat disposed on the positioning seat, a washer, a coiled spring, a first gasket having a first round aperture, a first oblong plate having a first oblong hole and a first circular hole, at least a second gasket having a second round aperture, at least a second oblong plate having a second oblong hole and a second circular hole, a tube, a nut, the connection seat receiving the washer and the coiled spring, the positioning seat having a bottom slot and a round hole, the positioning seat receiving the first gasket, the first oblong plate, the second gasket and the tube, a shaft passing through the connection seat, the washer, the coiled spring, the first gasket, the first oblong plate, the second gasket, the second oblong plate, the tube and the nut, a square plate inserted in the connection seat, and a control handle, the control handle having a connection block having a through hole, the connection seat having an inner interior and a through aperture, the connection block inserted in the connection seat, a pintle fastening the connection block and the connection seat together through the through aperture of the connection seat and the through hole of the connection block, the U-shaped frame receiving the first oblong plate and the second oblong plate, and a pin fastening the first oblong plate, the second oblong plate, and the U-shaped frame together.

* * * * *